US005093647A

United States Patent [19]

Noda et al.

[11] Patent Number: 5,093,647

[45] Date of Patent: Mar. 3, 1992

[54] SLIDING ELECTRIC PARTS

[75] Inventors: Shoji Noda; Kazuo Higuchi; Masao Kohzaki, all of Aichi, Japan

[73] Assignee: Kabushiki Kaisha Toyota Chuo Kenkyusho, Aichi, Japan

[21] Appl. No.: 593,890

[22] Filed: Oct. 5, 1990

[30] Foreign Application Priority Data

Oct. 6, 1989 [JP] Japan ..... 1-262372

[51] Int. Cl.[5] ..... H01C 10/30

[52] U.S. Cl. ..... 338/160; 338/162; 338/176; 338/307; 338/308

[58] Field of Search ..... 338/160-183, 338/13, 307, 308; 384/13

[56] References Cited

U.S. PATENT DOCUMENTS 4,797,011 1/1989 Saeki et al. ..... 384/13

5,001,452 3/1991 Imai et al. ..... 338/13

FOREIGN PATENT DOCUMENTS 57-33448 2/1982 Japan .

64-73510 2/1989 Japan .

*Primary Examiner*—Marvin M. Lateef

*Attorney, Agent, or Firm*—Oblon, Spivak, McClelland, Maier & Neustadt

[57] ABSTRACT

A sliding electric part includes a set of two sliding members, wherein one of the sliding members is composed of a diamond substrate with an electric conductive portion formed by ion implanation or by the deposition of boron-doped p-type diamond on the sliding surface which slides along the other sliding member, and the other sliding member has an electric conductive portion formed on the sliding surface which slides along the one sliding member.

15 Claims, 4 Drawing Sheets

SLIDING ELECTRIC PARTS

BACKGROUND OF THE INVENTION

1. Field of the Invention

The present invention relates to sliding electric parts which have an excellent wear resistance and are used for various position sensors or the like.

2. Description of the Related Art

Sliding electric parts such as a potentiometer which are used for positional sensors or the like are composed of a set of two sliding members which are required to have a high wear resistance with respect to each other.

As conventional sliding electric parts, a carbon resistor produced from a molded body of carbon particles and a resin which are mixed so as to have a desired resistance is used. A carbon resistor, however, is defective in that the contact resistance thereof becomes so high during use as to cause insufficient conduction. This is because the insulating wear debris (resin) produced on the sliding part disturbs the electric contact between the sliding electrodes.

Diamond is known as a material having an excellent wear resistance, and attempt has been made at utilizing diamond for sliding electric parts. For example, the electrostatic capacitance type video reproducing stylus disclosed in Japanese Patent Laid-Open No. 33448/1982 utilizes the fact that when diamond is ion-implanted at an appropriate temperature, the ion-implanted portion becomes conductive In the diamond stylus with ions implanted therein, a conductive layer is formed at a portion 0.2 to 0.4 μm deep from the diamond surface, so that the wear resistance inherent to diamond is kept. However, since the conductive portion is below the surface of the diamond, electric current does not flow between the two sliding members, so that the conductive diamond described in Japanese Patent Laid-Open No. 33448/1982 cannot constitute a sliding electric part such as a position sensor.

SUMMARY OF THE INVENTION

It is an object of the present invention to provide sliding electric parts having an excellent wear resistance.

According to the present invention, there is provided a sliding electric part comprising a set of two sliding members, wherein one of the sliding members is composed of a diamond substrate with an electric conductive portion formed by ion implantation on the sliding surface which slides along the other sliding member, and the other sliding member has an electric conductive portion formed on the sliding surface which slides along the one sliding member.

The sliding electric part provided in this aspect of the present invention is excellent in wear resistance. One sliding member is composed of diamond with the surface layer thereof made electrically conductive. This diamond has friction and wear characteristic substantially equal to that of ordinary diamond. Therefore, the sliding electric part in the first aspect of the present invention has a low frictional property and an excellent wear resistance.

According to the present invention, there is also provided a sliding electric part comprising a set of two sliding members, wherein one of the sliding members has an electric conductive portion formed by the deposition of boron-doped P-type diamond on the sliding surface which slides along the other sliding member, and the other sliding member has an electric conductive portion formed on the sliding surface which slides along the one sliding member.

The sliding electric part provided in this aspect of the present invention is excellent in wear resistance. On the surface of one sliding member, boron-doped P-type diamond is deposited. This diamond has friction and wear characteristic substantially equal to that of ordinary diamond Therefore, the sliding electric part in this aspect of the present invention has a low frictional property and an excellent wear resistance.

The above and other objects, features and advantages of the present invention will become more apparent from the following description when taken in conjunction with the accompanying drawings in which preferred embodiments of the invention are shown by way of illustrative examples.

DETAILED DESCRIPTION OF THE PREFERRED EMBODIMENTS

Figure 1:
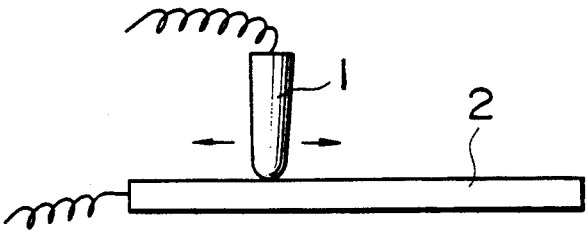
FIG. 1 is a plan view of a linear analog potentiometer according to a first embodiment of the present invention.

A sliding electric part according to the present invention will be explained in the following.

A sliding electric part in this aspect of the present invention comprises a set of two sliding members, wherein one of the sliding members is composed of a diamond substrate with an electric conductive portion formed by ion implantation on the sliding surface which slides along the other sliding member, and the other sliding member has an electric conductive portion formed on the sliding surface which slides along the one sliding member.

When ions are implanted into diamond, the diamond lattice is broken and the graphitic property appears, whereby the surface electric resistance is reduced. In other words, the portion in which the ions are implanted is considered to become a conductive hard carbon layer in which the network of polyaromatic carbon rings extends two-dimensionally, partially overlapped three-dimensionally, and which consists of amorphous carbon having a Mohs hardness of not less than 7.

With the increase in the ion dose, the diamond lattice is broken to a greater extent, and the surface electric resistance is reduced to a certain value. It is therefore possible to control the surface electric resistance by varying the ion dose.

It is possible to adjust the surface electric resistance to a predetermined value in the range of several Ω to several MΩ by adjusting the ion dose. For example, in a potentiometer, which is one of the sliding electric parts, a resistance of several kΩ to several ten kΩ is desirable from the point of view of accuracy.

In the diamond with the surface layer thereof made electrically conductive by ion implantation, the hardness of the surface layer is slightly lowered in comparison with diamond without ion implantation, but the implantation exerts almost no influence on the friction and wear characteristic which is almost equal to those of diamond without ion implantation.

The ions being implanted are not specified, and the ions of any given element can be used. However, use of nitrogen ions is the most economical because they are easily generated.

An ion energy of not less than 10 keV is preferable. If it is less than 10 keV, sputtering is caused, thereby making it difficult to form a stable electric conductive portion on the surface.

The preferred ion dose is in the range of $1\times10^{14}$ to $1\times10^{17}$ ions/cm$^2$. If the ion dose is less than $1\times10^{14}$ ions/cm$^2$, the reduction in the resistance is insufficient. When the ion dose is $1\times10^{17}$ ions/cm$^2$, the resistance is saturated and does not lower any further, so that ion implantation at a dose of more than $1\times10^{17}$ ions/cm$^2$ is uneconomical.

An ordinary ion accelerator can be used for the ion implantation.

It is unnecessary to use special ions for the ion implantation. It is therefore possible to use a cheap ion accelerator which is not equipped with a mass separator. If the ion beam technique is adopted, it is possible to form a minute electric conductive portion in the order of several hundred μm.

The temperature for implanting ions is preferably in the range of 77K to 500 K. Even if the temperature exceeds this range to a lower or higher temperature, since the resistance is already saturated, the expected enhancement of the effect is not obtained The thickness of the electric conductive portion is preferably not less than 0.1 μm. A thickness of less than 0.1 μm involves a fear of increase in the change in the electric resistance due to wear during a long-term use.

In order to form an electric conductive portion of a desired shape on the surface of a diamond substrate, ions are implanted only in the desired portion while masking the other portions at which the electric conductive portion is not to be formed.

The other sliding member may be any member so long as an electric conductive portion is formed on at least the surface thereof. For example, diamond which is made conductive, semiconductor SiC and semiconductor Si can produce a stable sliding property, because the coefficient of friction thereof with respect to diamond is as small as not more than 0.1 when they are slid along diamond without any lubrication, so that they do not produce much wear. Accordingly, the other sliding member may be a diamond substrate with an electric conductive portion formed on the surface like the one sliding member.

The thickness of the electric conductive portion of the other sliding member is preferably not less than 0.1 μm in the case of diamond which is made conductive. A thickness of less than 0.1 μm involves a fear of increase in the change in the electric resistance due to wear during a long-term use. In the case of SiC and Si, a semiconductor in the form of a bulk is usable.

Figure 2:
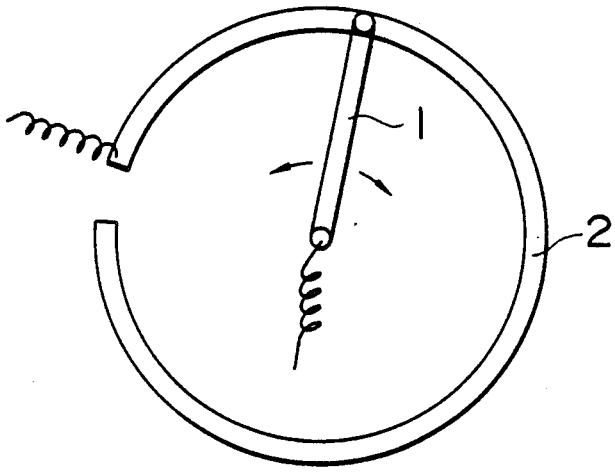
FIG. 2 is a plan view of a rotary analog potentiometer according to a second embodiment of the present invention.

A sliding electric part according to the present invention can constitute a potentiometer, which is utilized for a position sensor and an angle sensor such as an air flow sensor, a throttle sensor and a vehicle height sensor. For example, it can be used as a linear potentiometer (analog) such as that shown in FIG. 1 and a rotary potentiometer (analog) such as that shown in FIG. 2. A stylus (movable electrode) 1 is made of diamond and an electric conductive portion is formed at the tip by ion implantation. A stationary resistor 2 has an electric conductive portion on the surface along which the stylus 1 slides. The combination of the stylus 1 and the stationary resistor 2 may be reverse to the above-described combination.

Figure 3:
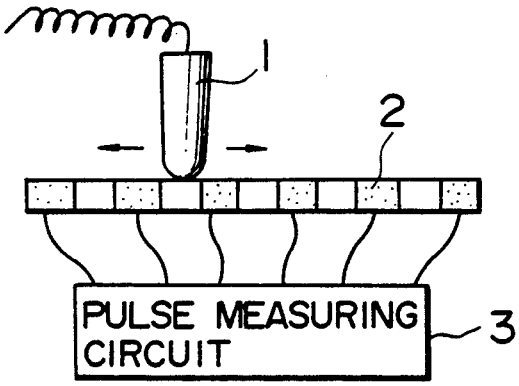
FIG. 3 is a plan view of a linear digital potentiometer according to a third embodiment of the present invention.
Figure 4:
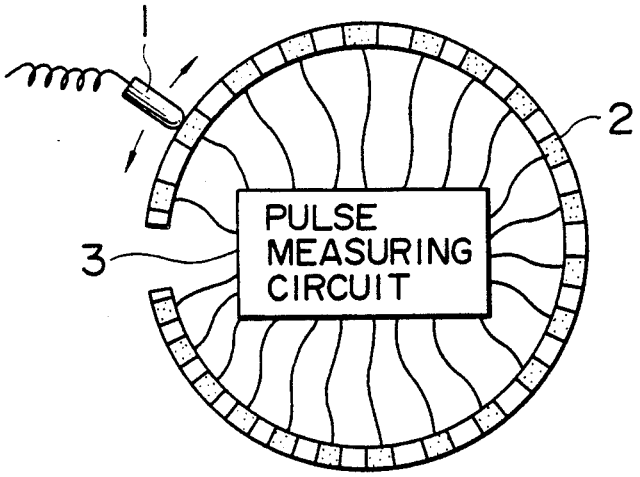
FIG. 4 is a plan view of a rotary digital potentiometer according to a fourth embodiment of the present invention.

A sliding electric part according to the present invention can also constitute a linear contact point type potentiometer (digital) such as that shown in FIG. 3 and a rotary contact point type potentiometer (digital) such as that shown in FIG. 4 which are incorporated into a pulse measuring circuit 3. The stylus 1 and the stationary resistor 2 has the same combination as the above-described one.

A sliding electric part in the second aspect of the present invention will be explained in the following.

A sliding electric part in the second aspect of the present invention comprises a set of two sliding members, wherein one of the sliding members has an electric conductive portion formed by the deposition of boron-doped P-type diamond on the sliding surface which slides along the other sliding member, and the other sliding member has an electric conductive portion formed on the sliding surface which slides along the one sliding member.

In vapor phase synthesis of diamond, methane diluted with hydrogen is generally used as a material gas. By mixing a compound containing boron atoms with a material gas, it is possible to deposit boron-doped P-type diamond on the substrate which has been subjected to appropriate pre-treatment. It is possible to adjust the electric resistance of the deposited diamond by adjusting the boron dose. The friction and wear characteristic of the boron-doped P-type diamond is almost equal to that of diamond without ion implantation.

As a substrate on which boron-doped P-type diamond is deposited, an insulating substrate such as Si and alumina is preferably used.

A process for depositing boron-doped P-type diamond is not specified and various processes may be adopted For example, P-type diamond is deposited on a substrate which has been subjected to surface treatment with abrasive of diamond powder and ion implantation by a known process such as hot-filament CVD (e.g, Iida, Okano and Kurosu in Solid State Physics 23. (5) 343 (1988)).

The thickness of the electric conductive portion formed by the deposition of boron-doped P-type diamond is preferably not less than 0.1 μm. A thickness of less than 0.1 μm involves a fear of increase in the change in the electric resistance due to wear during a long-term use.

In order to form an electric conductive portion of a desired shape on the surface, after the substrate is sonicated (surface treatment with abrasive)in alcohol with a diamond powder having a particle diameter of 20 to 30 μm dispersed therein, ions are implanted through a mask of the desired shape so as to selectively deposit boron-doped P-type diamond on the surface by hot-filament CVD or the like. In this way, boron-doped P-type diamond is selectively deposited on the surface only at the portion in which ions have not been implanted.

The other sliding member may be any member so long as an electric conductive portion is formed on at least the surface thereof. For example, diamond which is made conductive, semiconductor SiC and semiconductor Si can produce a stable sliding property, because the coefficient of friction thereof with respect to diamond is as small as not more than 0.1 when they are slid along diamond without any lubrication, so that they do not produce much wear. Accordingly, the other sliding member may be a diamond substrate with an electric conductive portion formed on the surface like the one sliding member.

The thickness of the electric conductive portion of the other sliding member is preferably not less than 0.1 μm in the case of diamond which is made conductive. A thickness of less than 0.1 μm involves a fear of increase in the change in the electric resistance due to wear during a long-term use. In the case of SiC and Si, a semiconductor in the form of a bulk is usable.

A sliding electric part according to the present invention can constitute a potentiometer, which is utilized for a position sensor and an angle sensor such as an air flow sensor, a throttle sensor and a vehicle height sensor such as those shown in FIGS. 1 to 4.

The present invention will be explained in more detail in the following with reference to the following examples.

EXAMPLE 1

A diamond film of 5 μm thick was deposited on mirror-polished $Si_3N_4$ substrate of 20 mm square and 3 mm thick by hot-filament CVD using $CH_4$ and $H_2$ in the ratio of 1/200 as a material gas and under a pressure of 50 Torr. The deposited diamond film was polished with a diamond paste to mirror finish The surface resistance of the diamond film was not less than $1\times10^{10}$ Ω/.

Figure 5:
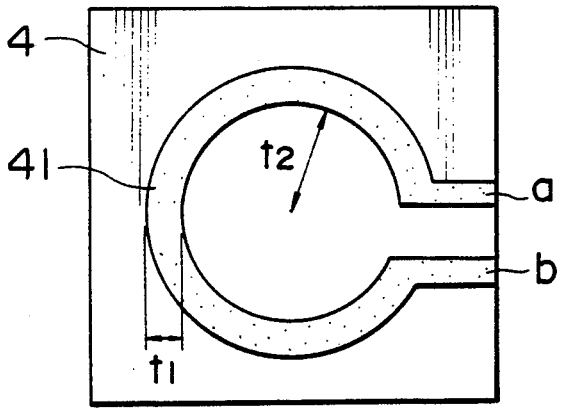
FIGS. 5 and 6 are a plan view and an elevational view, respectively, of one sliding member of the sliding electric part in Example 1.
Figure 6:
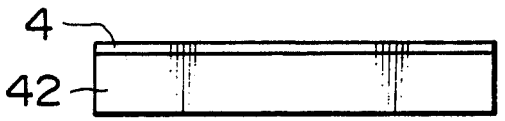

A copper mask was placed on the diamond film and $N_2$+ions were implanted through the mask at a dose of $1\times10^{15}$ to $1\times10^{17}$ ions/cm$^2$ at 100 keV at room temperature. In this way, an electric conductive portion 41 in the shape of a ring (width $t_1$:2 mm, radius $t_2$: 8 mm) with a partial cut was formed on the diamond film 4 deposited on the $SI_3N_4$ substrate 42, as shown in FIGS. 5 and 6.

The sheet resistance was measured by the four-point probe method.

TABLE

| Sample No | Ion dose (ions/cm$^2$) | Sheet resistance (Ω/□) |
|---|---|---|
| 1 | $1\times10^{15}$ | $10^5$ |
| 2 | $5\times10^{15}$ | $10^4$ |
| 3 | $1\times10^{16}$ | $10^3$ |
| 4 | $5\times10^{16}$ | $30^0$ |
| 5 | $1\times10^{17}$ | $30^0$ |

An electric conductive portion was formed in the same way as the above except for changing $N_2$ +ions into Ar+ ions. When the sheet resistance was measured, a similar result was obtained.

The resistance of Sample No. 3 measured by attaching a silver paste to both end portions (points a and b in FIG. 5) of the ion-implanted portion was 18 kΩ.

Figure 7:
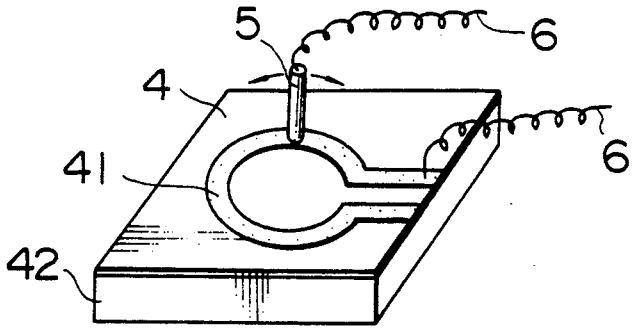
FIGS. 7 is a perspective view of the sliding electric part in Example 1.

As shown in FIG. 7, an electric wire 6 was connected to one end portion of the electric conductive portion 41 formed by the ion implantation of Sample No. 3, and a commercially available Ag-Pd alloy pin (the diameter of the tip: 3 mm) with the electric wire 6 attached thereto was placed on the electric conductive portion 41, thereby completing a sliding electric part (test product A) according to the present invention.

EXAMPLE 2

A sliding electric part in which one of the sliding members has an electric conductive portion formed by the deposition of boron-doped P-type diamond was produced The deposition of boron-doped P-type diamond was carried out by the method described in Solid State Physics 23 (5) 343 (1988). More specifically, $B_2O_3$ was dissolved in ethanol and the ethanol solution diluted with acetone to a predetermined concentration was introduced into a hot-filament CVD reactor as a reaction gas together with $H_2$ gas, thereby selectively depositing P-type diamond on an $Si_3N_4$ substrate. The $Si_3N_4$ substrate was sonicated for one hour in an ethanol solution with diamond particles having an average particle diameter of 25 μm dispersed therein. A Cu piece in the form of a ring with a partial cut was placed on the $Si_3N_4$ substrate and Ar+ions were implanted at 200 keV and at a dosage of $2\times10^{16}$ ions/cm$^2$.

Figure 8:
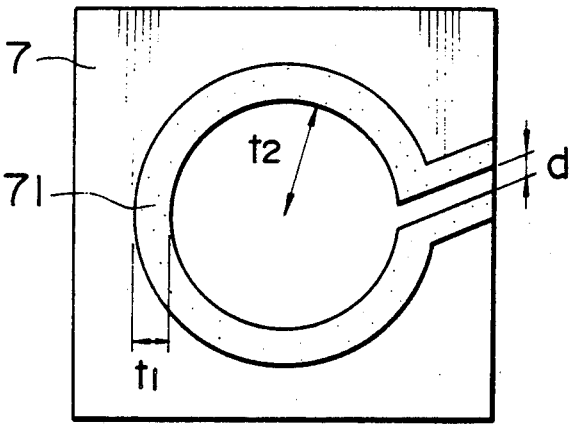
FIGS. 8 and 9 are a plan view and an elevational view, respectively, of one sliding member of the sliding electric part in Example 2.
Figure 9:
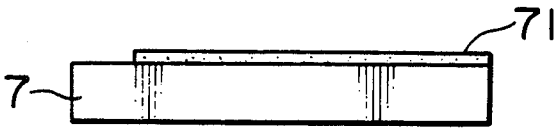

In this way, a boron-doped P-type diamond 71 in the shape of a ring (width $t_1$:2 mm, radius $t_2$:8 mm, thickness :5 μm) with a partial cut was deposited on the $Si_3N_4$ substrate 7, as shown in FIGS. 8 and 9.

The deposited diamond surface 71 was mirror-finished and the sheet resistance was measured When the amount of boron based on the amount of carbon in the reaction gas was about 10 ppm, the sheet resistance of the deposited diamond was 10 Ω/□. The resistance R and the ratio r (ppm) of the amount of boron with respect to the amount of carbon had a relationship of $\log R = 4 - \log r$.

When the resistance of the sample having a sheet resistance of about 1.5 kΩ was measured by attaching a silver paste to both end portions of the deposited diamond in the same way as in Example 1, it was 15 kΩ. The width (d) of the opening portions at both end portions of the deposited diamond was about 10 μm.

In the same way as in Example 1, an electric wire was connected to one end portion of the deposited diamond and a commercially available connecting material Ag-Pd alloy pin with the electric wire 6 attached thereto was placed on the deposited diamond, thereby completing a sliding electric part (test product B) according to the present invention.

COMPARATIVE EXAMPLE

Figure 10:
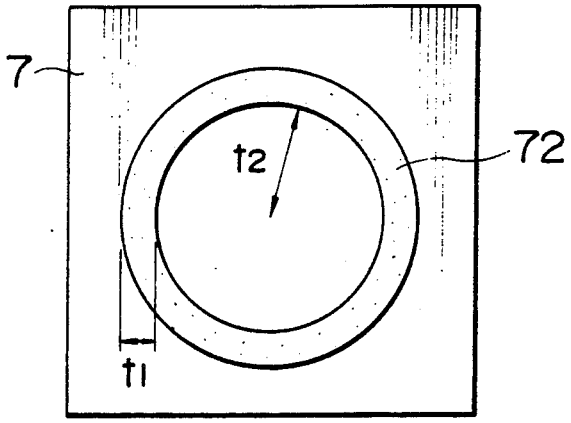
FIGS. 10 and 11 are a plan view and an elevational view, respectively, of one sliding member of the sliding electric part in Comparative Example.
Figure 11:
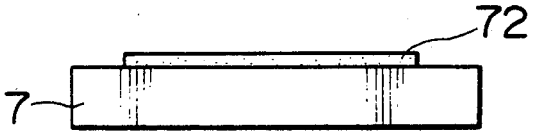

A ring was stamped out from a carbon resistor consisting of carbon particles of 100 μmΩ and an epoxy resin mixed in the volume ratio of 50 to 50 and having a thickness of 1 mm. The ring 72 (width $t_1$:2 mm, radius $t_2$:8 mm, thickness: 1 mm) was adhered to the $Si_3N_4$ substrate 7 of 20 mm square by an epoxy adhesive as shown in FIGS. 10 and 11. A ring similar to this ring was partially cut away, and a silver paste was adhered to both end portions thereof The resistance was measured to be 22 kΩ.

In the same way as in Example 1, an electric wire was connected to one end portion of the ring which had been partially cut, and an Ag-Pd alloy pin with the electric wire attached thereto was placed on the ring, thereby completing a sliding electric part (test product C). The electric wire was connected to the ring after the wear test, as shown in the following evaluation test.

EVALUATION TEST

Each of the sliding members in the form of a ring of the test products A, B and C was mounted on a pin-on-desk friction and wear tester to carry out the wear test on the test products A and B with respect to a diamond pin (the diameter of the tip: 3 mm) and the test product C with respect to a commercially available material Ag-Pd alloy pin (the diameter of the tip: 3 mm) in air at room temperature under a normal load of 100 gf at a rate of 100 rpm for 100 hours. As to the test product C, since the pin would be engaged with the cut portion during the wear test, the wear test was carried out on a whole ring and after the wear test, the ring was partially cut away and the electric wire was connected to the end portion After the wear test, the slinging member in the form of a ring was rotated at a rate of 6°/sec by a pulse motor so as to measure the sliding resistance with respect to an Ag-Pd alloy pin. The results are shown in FIG. 12.

Figure 12:
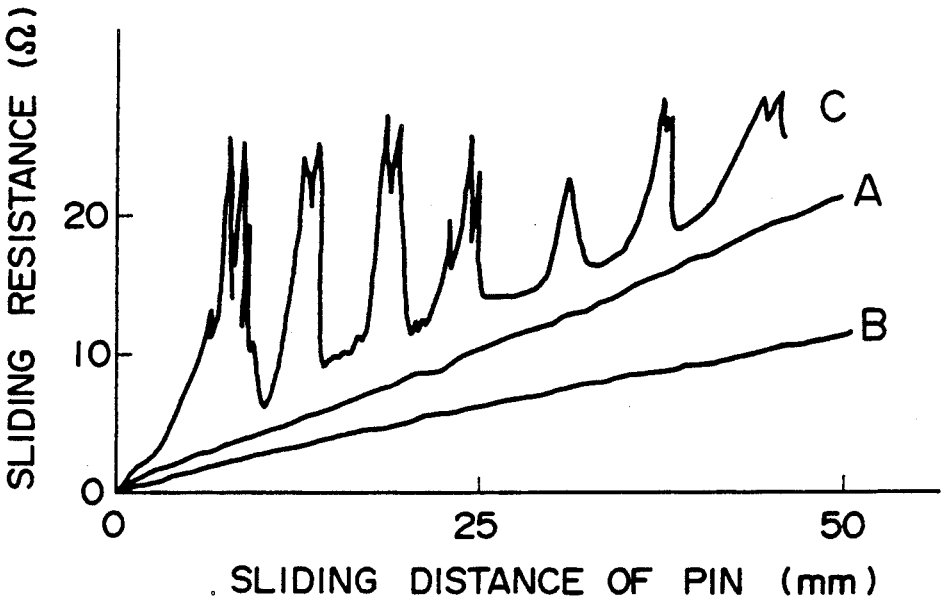
FIG. 12 is a graph showing the sliding resistance characteristics of the sliding electric parts in Examples 1 and 2 and Comparative Example after the wear test.

As is obvious from FIG. 12, a rapid increase in the resistance was generated at several points in the test product C. In contrast, a substantially linear change was observed in the test products A and B. The rapid increase in the resistance in the test product C was attributable to the fact that a part of the surface of the carbon resistor became insulating. It was found from the observation through a scanning electron microscope that the surface of the carbon resistor which had been covered with the epoxy resin formed the insulating portion.

What is claimed is:

1. A sliding electric part comprising a set of two sliding members, wherein one of said sliding members is composed of a diamond substrate with an electric conductive portion formed by ion implantation on the sliding surface which slides along the other sliding member, and said other sliding member has an electric conductive portion formed on the sliding surface which slides along said one sliding member.

2. A sliding electric part according to claim 1, wherein said electric conductive portion formed on said one sliding member is composed of a conductive hard carbon layer in which the network of polyaromatic carbon rings extends two-dimensionally, partially overlapped three-dimensionally, and which consists of amorphous carbon having a Mohs hardness of not less than 7.

3. A sliding electric part according to claim 1, wherein the ions implanted into said one sliding member are nitrogen ions.

4. A sliding electric part according to claim 1, wherein the energy for implanting ions in said one sliding member is not less than 10 keV

5. A sliding electric part according to claim 1, wherein the dose of ions implanted in said one sliding member is $1\times10^{14}$ to $1\times10^{17}$ ions/cm$^2$.

6. A sliding electric part according to claim 1, wherein the thickness of said electric conductive portion formed on said one sliding member is not less than 0.1 μm.

7. A sliding electric part according to claim 1, wherein said other sliding member is formed of at least one material selected from the group consisting of diamond which is made conductive, semiconductor SiC and semiconductor Si.

8. A sliding electric part according to claim 1, wherein the thickness of said electric conductive portion formed on said other sliding member is not less than 0.1 μm.

9. A sliding electric part comprising a set of two sliding members, wherein one of said sliding members has an electric conductive portion formed by the deposition of boron-doped P-type diamond on the sliding surface which slides along the other sliding member, and said other sliding member has an electric conductive portion formed on the sliding surface which slides along said one sliding member.

10. A sliding electric part according to claim 9, wherein the thickness of said electric conductive portion formed on said one sliding member is not less than 0.1 μm.

11. A sliding electric part according to claim 9, wherein said one sliding member has an insulating substrate.

12. A sliding electric part according to claim 11, wherein said insulating substrate is formed of at least one material selected from the group consisting of Si and alumina.

13. A sliding electric part according to claim 9, wherein said other sliding member is formed of at least one material selected from the group consisting of diamond which is made conductive, semiconductor SiC and semiconductor Si.

14. A sliding electric part according to claim 9, wherein the thickness of said electric conductive portion formed on said other sliding member is not less than 0.1 μm.

15. A sliding electric part according to claim 1, wherein the ions are implanted at a temperature range of between 77° K. and 500° K.

* * * * *